US005728968A

United States Patent [19]

Buzzett et al.

[11] Patent Number: 5,728,968

[45] Date of Patent: Mar. 17, 1998

[54] ARMOR PENETRATING PROJECTILE

[75] Inventors: Joseph Gannon Buzzett, Tampa; David A. Edmonds, Palm Harbor; Earl R. Edmondson, St. Petersburg, all of Fla.

[73] Assignee: Primex Technologies, Inc., St. Petersburg, Fla.

[21] Appl. No.: 398,022

[22] Filed: Aug. 24, 1989

[51] Int. Cl.[6] ..... F42B 12/04

[52] U.S. Cl. ..... 102/364; 102/473; 102/517; 102/703

[58] Field of Search ..... 102/364, 365, 102/473, 476, 517–519, 703

[56] References Cited

U.S. PATENT DOCUMENTS

| | | | |
|---|---|---|---|
| 2,345,619 | 4/1944 | Moore | 102/92.5 |
| 2,409,307 | 10/1946 | Patch et al. | 102/92.5 |
| 2,446,082 | 7/1948 | Dixon | 102/66 |
| 2,475,632 | 7/1949 | Moore et al. | 102/364 |
| 2,532,323 | 12/1950 | Miller, Jr. | 102/90 |
| 3,208,385 | 9/1965 | Perniss | 102/66 |
| 3,695,951 | 10/1972 | Helms, Jr. et al. | 149/19 |
| 4,102,271 | 7/1978 | Bethman | 102/52 |
| 4,112,846 | 9/1978 | Gilbert et al. | 102/52 |
| 4,237,787 | 12/1980 | Wacula | 102/577 |
| 4,384,528 | 5/1983 | Moore et al. | 102/519 |
| 4,437,409 | 3/1984 | Freymond | 102/364 |
| 4,497,253 | 2/1985 | Schranski | 102/476 |
| 4,625,650 | 12/1986 | Bilsbury | 102/516 |
| 4,638,738 | 1/1987 | Bisping et al. | 102/516 |
| 4,831,936 | 5/1989 | Brattstrom et al. | 102/476 |

OTHER PUBLICATIONS

A. G. Rozner and H. H. Helms, "Powder–powered torch cuts with molten jet" Welding and Metal Fabricating, Apr., 1979.

*Primary Examiner*—Michael J. Carone
*Attorney, Agent, or Firm*—Gregory S. Rosenblatt; Wiggin & Dana

[57] ABSTRACT

An armor penetrator projectile is disclosed that has an elongated rod penetrator core. The core has a central bore therein extending from a rear portion to a front end portion of the core. The front end portion is preferably conically shaped for impact with an armor plate. A self igniting pyrotechnic material such as thermite is packed within the rear portion and in the bore. The thermite is ignited by the frictional heat and pressure generated during projectile impact with a target armor plate. The ignited thermite ejects a molten jet of material through the bore and forwardly out through the impacting front end thus further melting the armor plate about the point of impact and enhancing the behind armor destructive effects of the projectile.

18 Claims, 2 Drawing Sheets

ARMOR PENETRATING PROJECTILE

This invention generally relates to a projectile adapted to penetrate armor plate and more particularly to a projectile including a hard, heavy metal tubular penetrator core containing a pyrotechnic material.

Various arrangements of armor piercing projectiles have been advanced for penetrating heavy metal armor plate. A typical subcaliber penetrator arrangement is disclosed in U.S. Pat. No. 4,638,738. These in general either utilize a hard penetrator core or an explosive shape charge. Some of these further include explosive or incendiary charges within a generally tubular penetrator core.

Examples of conventional incendiary projectiles having generally tubular penetrator cores are disclosed in U.S. Pat. Nos. 2,345,619; 2,532,323; 2,446,082; and 3,208,385. Each of these patents teaches a structure for penetrating a metal or other body and igniting an integrally contained incendiary to destroy whatever is behind the surface of the body. However, the combustion of the incendiary in each of these is generally randomly directed and unfocused. In addition, when a generally stable incendiary material is used, an explosive ignition charge must be suppled to ensure ignition of the incendiary upon target impact.

Another conventional incendiary projectile, disclosed in U.S. Pat. No. 4,237,787, utilizes a firmly packed thermite type composition both in front of and behind the hollow nose of the penetrator core. The front incendiary ignites upon target impact and the incendiary behind the nose portion is ignited following penetration of the target to increase behind armor destructive effects. This arrangement is effective to ignite fuel canisters and thin skinned vehicles, but would be ineffective against heavily armored vehicles. The steel casing between the front and rear incendiary charge will fracture upon impact to ignite the rear charge, thus providing a delay between the burning of the two charges.

A more effective design to penetrate heavy armor is a combination of both penetrator core and an explosive shape charge packaged together in the same projectile. One such arrangement is disclosed in U.S. Pat. No. 4,102,271 issued to Betheman. The Betheman patent discloses a tandem arrangement of a conical rod penetrator and a shape charge tandemly arranged with the shape charge behind the penetrator rod. A central axial bore through the penetrator rod directs the shape charge jet of material to the forward end of the penetrator to enhance penetration. This device is particularly designed for use against compartmentalized armor and reactive armor. Actuation of the shape charge is deliberately delayed so as to defeat the main armor beneath an outer armor layer. The penetration in armor plate with the conical penetrator portion of this prior art design is limited by the kinetic energy of the penetrator core. The Betheman arrangement does not improve the after armor lethality capability of the penetrator core. Rather, the conical tubular penetrator rod primarily shields the path of the shape charge jet so that the jet directly impacts and bores into the main armor. If the outer armor thickness is substantial then the tandem arrangement of the shape charge may not defeat the armor beneath. In addition, the presence of a high explosive shape charge in the projectile disclosed in this prior art patent, as well as in other conventional arrangements, such as in U.S. Pat. Nos. 4,625,650 and 4,497,253, presents an inherently substantial handling hazard because of the presence of the explosive.

Accordingly, there is a need for an armor piercing projectile which enhances the after armor effects capability or lethality of the penetrator core without containing explosives. There is also a need for a penetrator core design which focuses or directs the ignited incendiary or pyrotechnic material to the forward path of the projectile. In addition, there is always a need for a simple self igniting incendiary projectile design to increase armor penetration and after armor effects which inherently increases functional reliability.

The present invention addresses these needs by providing a simple, partially hollow, rod penetrator design in conjunction with a self igniting pyrotechnic material. The pyrotechnic material used in the present invention, preferably a thermite mixture, is extremely stable under normal environmental conditions and thus presents a very low handling hazard. One preferable pyrotechnic material is disclosed in U.S. Pat. No. 3,695,951 issued to Helms et al and is incorporated herein by reference. The pyrotechnic material, positioned behind the forward end of the penetrator, is ignited by the heat and pressure created as a natural result of impact. The burning pyrotechnic material, requiring no external oxygen, produces a molten jet of metal and oxides under high gas pressure which is directed forward to the impact point to increase after armor effects.

The rod penetrator of the present invention has a partial axial through bore in front of the main pyrotechnic charge wherein a portion of the pyrotechnic material resides. This portion of the pyrotechnic material, when ignited on impact, in turn ignites the main charge of pyrotechnic material. The bore acts as a nozzle which directs the flow of burning material which forms a jet of molten metal and oxides at high pressure to the point of impact, melting the metal of the armor plate at the same time that the penetrator core is punching through the armor plate. The additional flow of molten metal and oxide material to the impact point further spews past the armor plate and substantially enhances the after armor effects of the projectile once penetration has been achieved.

The present invention is further set forth in the following detailed description of a preferred embodiment thereof.

Figure 1:
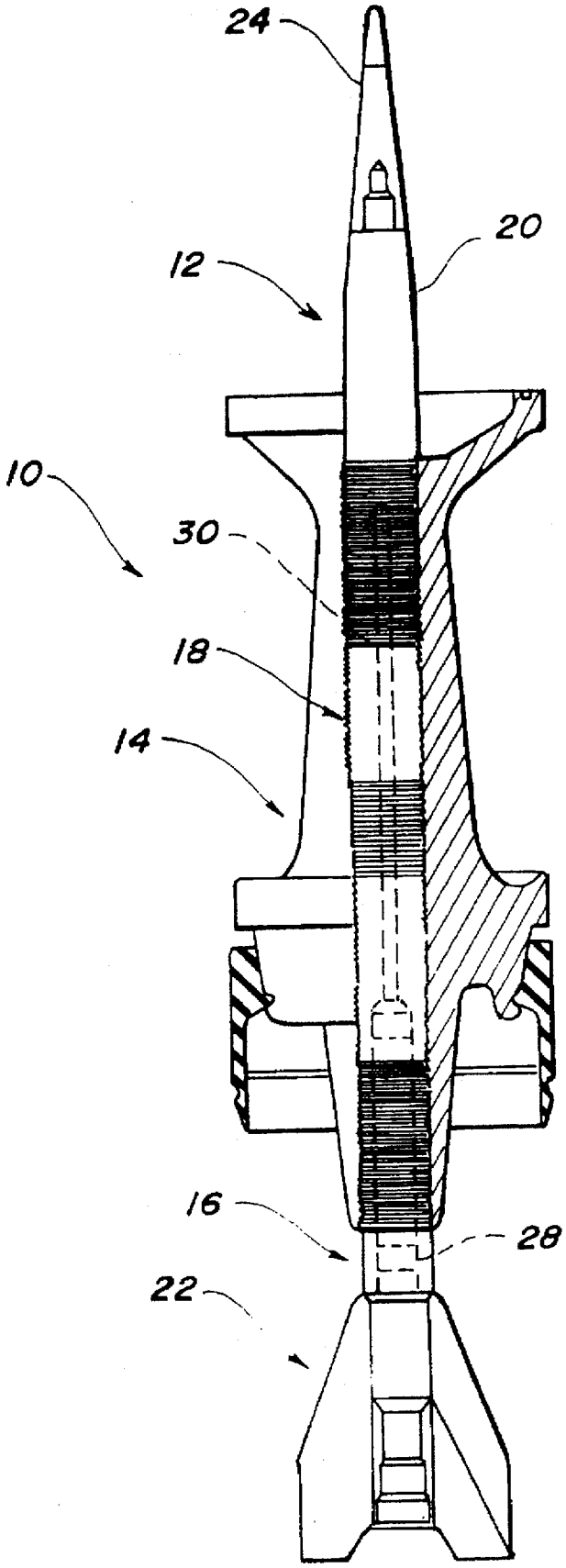
FIG. 1 is a partial sectional view of a saboted penetrator projectile in accordance with the present invention.

Turning now to the drawing, a saboted subcaliber armor penetrating projectile assembly 10 in accordance with the present invention is shown in FIG. 1 and indicated generally by the reference numeral 10. The projectile assembly 10 includes a penetrator core body 12 and a sabot 14 around core body 12. The core body 12 has a rear portion 16, a mid portion 18 and a front end portion 20. A stabilizing fin assembly 22 is fixed to the rear portion 16 of the penetrator core body 12 and a streamlined plastic nose cone 24 is secured to the forward end portion 20. The fin assembly 22 and nose cone 24 provide aerodynamic stabilization and improved flight accuracy of the penetrator core body 12 after separation of the sabot 14.

The presence of sabot 14, fin assembly 22, and nose cone 24 is not required for the functioning of the projectile according to the present invention as set forth below. These components are merely illustrative of a preferred embodiment of the invention in a subcaliber kinetic energy projectile configuration.

The penetrator core body 12 is an elongated generally cylindrical rod of a heavy, extremely hard metal for penetrating armor plate, preferably tungsten, a tungsten alloy, depleted uranium, or other typical penetrator material. Penetration is maximized by concentrating the kinetic energy of impact over a small area of the target armor plate.

Accordingly, the front end portion 20 of the penetrator core 12 has an approximately truncated cone shape. The plastic nose cone 24 is in turn fixed to the forward end of front end portion 20 giving an overall smooth pointed shape to the projectile.

Figure 2:
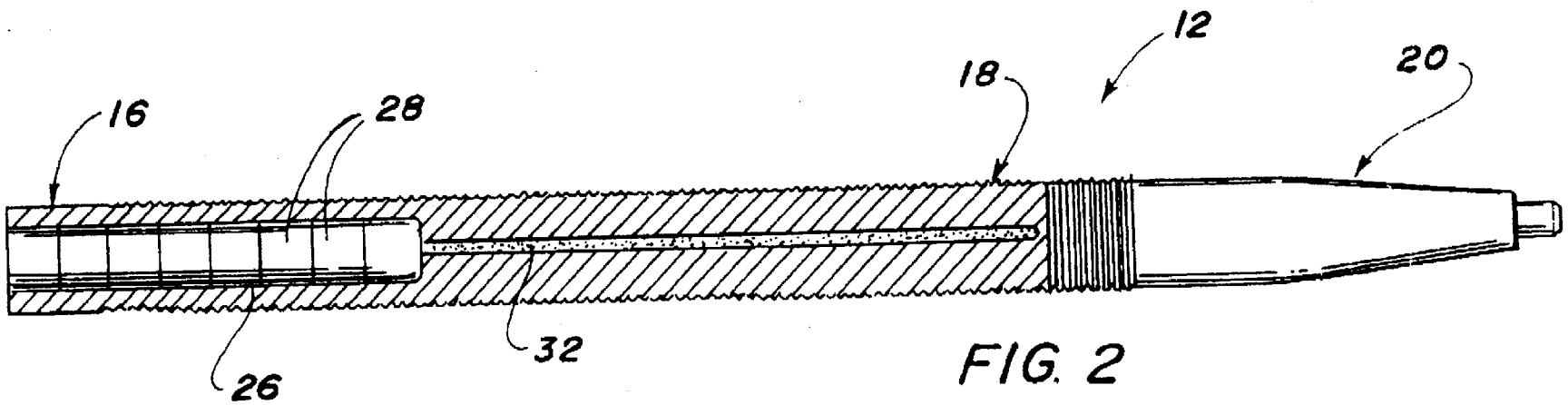
FIG. 2 is an enlarged sectional view of the penetrator projectile shown in FIG. 1.

Specifically in reference to FIG. 2, the rear portion of penetrator core body 12 has a central, axially aligned, generally cylindrical cavity 26 therein forming a housing for a plurality of compacted pyrotechnic pellets 28 preferably disc shaped and stacked axially. These pellets are a pyrotechnic mixture such as Pyronol which is a thermite-like mixture of nickel, aluminum iron oxide, and a flurocarbon binder. Since thermite is self oxidizing, the reaction does not require external support of oxygen. When initiated, the exothermic reaction generates extreme heat, high gas pressure, and a molten mass of metal and oxides.

In the middle portion 18 of penetrator core 12 is a narrow central axial bore 30 connecting cavity 26 with front end portion 20. The bore 30 preferably has a diameter about 1/10 that of the cavity 26. The bore 30 houses an initiating powder 32. This initiating powder 32 is also a self oxidizing pyrotechnic mixture such as a thermite material. The initiating powder 32 is preferably Pyronol in powder form.

When penetrator core 12 impacts a target armor plate, the impact creates a substantial amount of heat, well in excess of 660° C., and liquifies a part of the front end portion 20. The powder 32 ignites when it reaches the melting point of aluminum, about 660° C. Once initiated, the thermochemical reaction in bore 30 propagates spontaneously, igniting the thermite pellets 28 in cavity 26. The burning pellets 28 create a molten stream of metal and metal oxide products at a temperature of about 2800° C. This stream is forced, by the gas pressures of the reaction, in a molten jet through the narrow nozzle formed by the narrow bore 30 through the mid portion 18 into and through the front end portion 20.

The molten jet burns forwardly into and through the armor virtually simultaneously with the kinetic energy dissipation of the penetrator core 12. If the core 12 penetrates entirely through the armor, the Pyronol burn continues, enhancing the potential for complete ignition and destruction of any material behind the armor in the generally forward path of the penetrator core 12.

Thus the penetrator core 12 of the present invention combines the features of a kinetic energy round with a self initiating pyrotechnic charge to increase the after armor effects. Since the pyrotechnic material, a thermite mixture such as Pyronol, requires an initiation temperature of at least 660° C., there is very little danger of ignition during normal handling. No explosive is utilized and therefore there is virtually no personnel hazard associated with handling the projectile assembly. Only the heat generated during impact of the core 12 with a target armor is sufficient to generate the required initiation temperatures.

Although the penetrator projectile according to the invention has been described with a certain degree of particularity it is to be understood that the present disclosure has been made only by way of example. For example other pyrotechnic materials may be used so long as they are self sustaining, requiring no external oxygen to support the exothermic reaction. Numerous changes in the details of construction and the combination and arrangement of parts of the projectile illustrated in the preferred embodiment may also be resorted to without departing from the spirit and scope of the invention as set forth in the following claims.

What is claimed is:

1. An armor penetrating subcaliber saboted kinetic energy penetrator projectile comprising:

a generally rod shaped penetrator core body of a hard metal material having one solid end portion for impacting and penetrating an armor plate;

self oxidizing pyrotechnic means within said body for producing a forwardly directed molten jet of metal from within said body during impact of said end portion of said body with said armor plate;

conduit means within said core body for directing said molten jet forwardly to and through said end portion impacting said armor plate so as to increase the frontal destruction of said armor and behind said armor by said molten jet; and means located within said conduit means for igniting said pyrotechnic means.

2. The projectile according to claim 1 wherein said igniting means includes a self igniting pyrotechnic material ignited by heat and pressure generated by the impact of said end portion of said core body with said armor plate.

3. The projectile according to claim 2 wherein said core body further comprises a cavity therein forming a housing containing said pyrotechnic means.

4. The projectile according to claim 3 wherein said conduit means includes at least one bore through a portion of said core body, said bore connecting said one end portion with said housing containing said pyrotechnic means.

5. The projectile according to claim 4 wherein said cavity and said bore are tandemly arranged along the longitudinal axis through said core body.

6. The projectile according to claim 5 wherein said bore is closed at said one end portion.

7. The projectile according to claim 1 wherein said conduit means includes at least one bore through a portion of said core body connecting said pyrotechnic means to said end portion.

8. The projectile according to claim 7 wherein said bore contains at least a portion of said pyrotechnic means adjacent said end portion, said portion of said pyrotechnic means being self ignited by impact heat and pressure generated during the impact of said body with said armor plate.

9. The projectile according to claim 8 wherein said bore is closed at said one end portion.

10. The projectile according to claim 8 wherein said bore is aligned along the longitudinal axis of said core body.

11. The projectile according to claim 10 wherein said penetrator core body is made of tungsten.

12. An armor penetrating subcaliber kinetic energy projectile comprising:

an elongated generally cylindrical penetrator core body of a hard metal material having one solid end portion shaped for impacting and penetrating an armor plate, said body having a central blind bore therein extending along the longitudinal axis of said body rearward of said one end;

a primary pyrotechnic material consisting essentially of finely divided pyronol disposed in said bore, said material self igniting under heat and pressure produced by the impact between said end portion and said armor plate; and a secondary self oxidizing pyrotechnic material consisting essentially of pyronol pellets tandemly arranged within said body behind and communicating with said self igniting pyrotechnic material in said bore, said secondary pyrotechnic material providing a sustained flow of molten metal forwardly to and through said one end through said bore when ignited by said self igniting material so as to enhance behind armor effects forward of the point of impact.

13. The projectile according to claim 11 wherein said primary self igniting pyrotechnic material is a finely divided powder.

14. The projectile according to claim 12 wherein said secondary pyrotechnic material comprises at least one solid body of a thermite material.

15. The projectile according to claim 13 wherein said primary pyrotechnic powder is a thermite.

16. The projectile according to claim 14 wherein said primary and secondary pyrotechnic materials are Pyronol.

17. The projectile according to claim 14 wherein said core body is tungsten.

18. A saboted long rod kinetic energy subcaliber penetrator projectile comprising:

a rod shaped penetrator core body made of a heavy metal having a solid front end portion for impacting and penetrating a heavy armor plate, an intermediate portion and a rear portion, said rear portion having a cylindrical cavity therein, said intermediate portion having a central bore therethrough connecting said cavity to said front end portion;

a primary self igniting pyrotechnic material consisting essentially of a finely divided pyronol disposed in said bore and arranged so as to ignite upon impact of said front end portion with said armor plate upon reaching a temperature of about 660 degrees centigrade; and a secondary self oxidizing pyrotechnic material consisting essentially of pyronol pellets tandemly arranged in said cavity along the longitudinal axis of said core body, said primary material communicating with said pellets so that said pellets ignite to provide a sustained flow of molten metal forwardly through said bore into and through said end portion upon impact of said front end portion with said armor plate.

* * * * *